US008317030B2

(12) United States Patent
Smith

(10) Patent No.: US 8,317,030 B2
(45) Date of Patent: Nov. 27, 2012

(54) FLANGED PERFORATED METAL PLATE FOR SEPARATION OF PELLETS AND PARTICLES

(75) Inventor: Joseph Leonard Smith, Cincinnati, OH (US)

(73) Assignee: M-I L.L.C., Houston, TX (US)

( * ) Notice: Subject to any disclaimer, the term of this patent is extended or adjusted under 35 U.S.C. 154(b) by 43 days.

(21) Appl. No.: 12/951,763

(22) Filed: Nov. 22, 2010

(65) Prior Publication Data

US 2011/0120920 A1 May 26, 2011

Related U.S. Application Data

(60) Provisional application No. 61/263,946, filed on Nov. 24, 2009.

(51) Int. Cl.
*B07B 1/46* (2006.01)

(52) U.S. Cl. ..... 209/399; 209/397; 209/405

(58) Field of Classification Search ..... 209/397, 209/399

See application file for complete search history.

(56) References Cited

U.S. PATENT DOCUMENTS

| | | | | |
|---|---|---|---|---|
| 237,297 | A * | 2/1881 | Lewis | 209/397 |
| 1,606,545 | A * | 11/1926 | Van Saun | 241/72 |
| 3,035,700 | A * | 5/1962 | McCausland | 209/405 |
| 3,170,875 | A * | 2/1965 | Swett | 210/465 |
| 3,352,418 | A * | 11/1967 | Swallow | 209/403 |
| 3,960,731 | A | 6/1976 | Brandt | |
| 4,347,129 | A * | 8/1982 | Rutherford | 209/399 |
| 4,810,372 | A | 3/1989 | Jones | |
| 5,051,171 | A | 9/1991 | Hukki | |
| 5,851,393 | A | 12/1998 | Carr et al. | |
| 7,913,853 | B2 * | 3/2011 | DeCenso et al. | 209/405 |
| 2008/0277322 | A1 * | 11/2008 | Smith | 209/363 |

FOREIGN PATENT DOCUMENTS

| | | | |
|---|---|---|---|
| JP | 05253546 | A * | 10/1993 |
| JP | 2002-346479 | A | 12/2002 |
| KR | 20040045048 | A | 6/2004 |

OTHER PUBLICATIONS

International Search Report and Written Opinion issued in corresponding International Application No. PCT/US2010/057806; Dated Aug. 30, 2011 (8 pages).

* cited by examiner

*Primary Examiner* — Joseph C Rodriguez
(74) *Attorney, Agent, or Firm* — Osha Liang LLP

(57) ABSTRACT

A perforated plate for a vibratory sifter, the perforated plate including a base plate comprising a plurality of openings formed therethrough, and a flange integrally formed with the base plate. A method of forming a screen assembly for a vibratory sifter, the method including forming a base plate, forming a plurality of openings extending from a top surface to a bottom surface of the base plate, and forming an integral flange on the base plate.

8 Claims, 5 Drawing Sheets

FLANGED PERFORATED METAL PLATE FOR SEPARATION OF PELLETS AND PARTICLES

BACKGROUND OF INVENTION

1. Field of the Invention

Embodiments disclosed here generally relate to a screening assembly for a vibratory sifter. In particular, embodiments disclosed herein relate to perforated plates for vibratory sifters. More specifically, embodiments disclosed herein relate to flanged perforated plates for vibratory sifters and methods of forming flanged perforated plates for vibratory sifters.

2. Background Art

Generally, sifters include a class of vibratory devices used to separate sized particles, as well as to separate solids from liquids. Sifters are used to screen, for example, feed material, plastic resins, and powders during industrial sorting and/or manufacturing operations.

Sifters include a filter screen through which sized materials or liquids are separated. The filter screen typically include a perforated plate base upon which a wire mesh or other perforated filter overlay is positioned. The perforated plate base generally provides structural support and allows the passage of fluids or sized material therethrough, while the wire mesh overlay defines the largest solid particle capable of passing therethrough. While many perforated plate bases are flat or slightly arcuate, it should be understood that perforated plate bases having a plurality of corrugated or pyramid-shaped channels extending thereacross may be used instead.

In certain applications, a flat smooth surface may be required for separation or sifting of materials having specific sizes or shapes. In these applications, a wire mesh overlay having a typical square filter opening may prevent materials having other desired shapes from passing through the filter. Thus, in certain applications where a particular size or shaped material may not be properly filtered through a wire mesh, a perforated plate having properly sized and shaped openings may be used to separate the material. The openings in the perforated plate may be formed by punching or stamping holes in a plate.

Because sifters may be in continuous use, repair operations and associated downtimes need to be minimized as much as possible. Often, the filter screens and/or perforated base plates of sifters, through which sized materials or liquids are separated, wear out over time and subsequently require replacement. Therefore, sifter filter screens and perforated base plates are typically constructed to be removed and replaced.

FIG. 1 shows an example of a perforated plate 10 for use in vibratory sifters. Typically, a tension ring 12 or other structural element is coupled to a lower surface 13 of the perforated plate 10 proximate an outer edge 14 of the perforated plate 10 to allow the perforated plate 10 to be mounted into a standard outer frame of a vibratory sifter (not shown). The tension ring 12 may be coupled to the perforated plate 10 by welding or chemical adhesives. However, welding of the tension ring to the perforated plated may distort thin perforated plates due to the high temperatures used in the welding process. Additionally, adhesives used for coupling the tension ring 12 to the perforated plate 10 may affect the reliability of the separator or the compatibility of the separator with certain applications where sanitary environments are required, e.g., food and pharmaceutical applications. The tension ring 12 may be formed of a wire mesh, plastic, metal, or any other material known in the art. The tension ring 12 may then be inserted into a screen retainer or screen groove (not shown) formed on an inner surface of the outer frame of the vibratory sifter (not shown). As shown in FIG. 1, the tension ring 12 may be coupled to a circumferential gasket 15. A circumferential groove 16 may be formed on an inner surface 17 of the circumferential gasket 15 and configured to receive a radially outwardly extending lip 18 formed on the tension ring 12. The circumferential gasket 15 may then be inserted into a screen retainer or screen groove (not shown) formed on an inner surface of the outer frame of the vibratory sifter (not shown).

Typically, screens used with sifters are placed in a generally horizontal fashion on a substantially horizontal bed or support structure located within a basket in the sifter. The screens themselves may be flat, nearly flat, corrugated, depressed, and/or contain raised surfaces. The basket in which the screens are mounted may be inclined towards a discharge end of the sifter. During operation, the sifter imparts a rapidly reciprocating motion to the basket and the screens. A source material, from which particles are to be separated, is poured onto a back end of the vibrating screen. The material generally flows toward the discharge end of the basket. Large particles that are unable to pass through the screen remain on top of the screen and move toward the discharge end of the basket where they are collected. Smaller particles and/or fluid pass through the screen and collect in a bed, receptacle, or pan therebeneath.

Accordingly, there exists a continuing need for a perforated plate that may be easily installed in a vibratory sifter that efficiently filters material in a sanitary and useful manner.

SUMMARY OF INVENTION

In one aspect, embodiments disclosed herein relate to a perforated plate for a vibratory sifter, the perforated plate including a base plate comprising a plurality of openings formed therethrough, and a flange integrally formed with the base plate.

In another aspect, embodiments disclosed herein relate to a screen assembly for a vibratory sifter, the screen assembly including a base plate comprising a plurality of openings formed therethrough, a flange integrally formed with the planar circular plate, and a gasket coupled to at least a portion of the flange.

In yet another aspect, embodiments disclosed herein relate to a method of forming a screen assembly for a vibratory sifter, the method including forming a base plate, forming a plurality of openings extending from a top surface to a bottom surface of the base plate, and forming an integral flange on the base plate.

Other aspects and advantages of the invention will be apparent from the following description and the appended claims.

DETAILED DESCRIPTION

Embodiments disclosed here generally relate to a screening assembly for a vibratory sifter. In particular, embodiments disclosed herein relate to perforated plates for vibratory sifters. More specifically, embodiments disclosed herein relate to flanged perforated plates for vibratory sifters and methods of forming flanged perforated plates for vibratory sifters.

Figure 1:
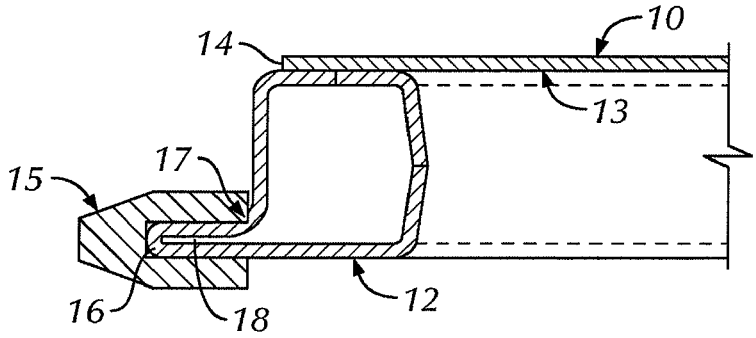
FIG. 1 (PRIOR ART)
FIG. 1 is a cross-sectional view of a conventional screen assembly of a perforated plate for a vibratory sifter.
Figure 2:
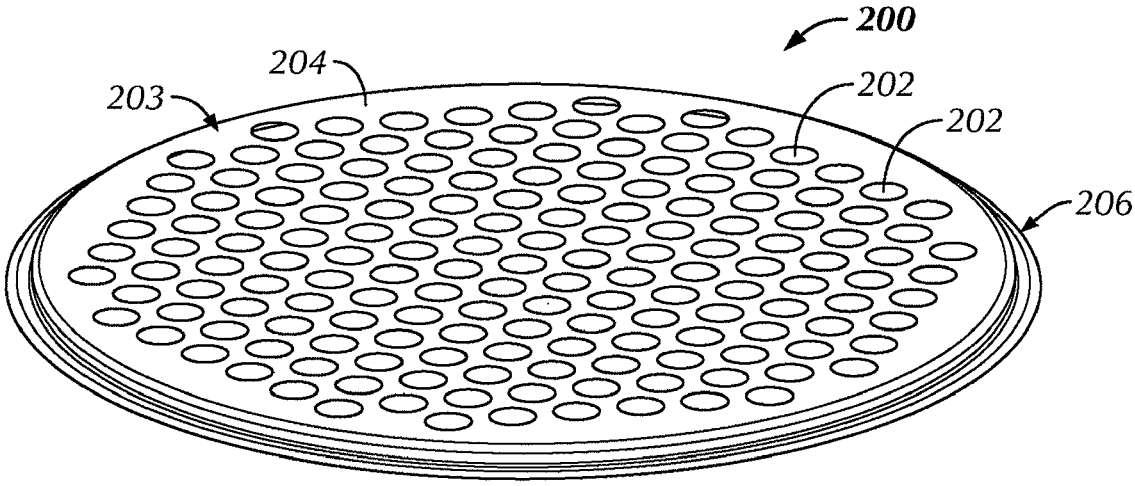
FIG. 2 is a perspective view of a perforated plate for a vibratory sifter in accordance with embodiments disclosed herein.

Referring initially to FIG. 2, a perforated plate 200, having a base plate 203, formed in accordance with embodiments disclosed herein is shown. As shown, the base plate 203 is substantially circular. In some embodiments, the perforated plate 200 may be elliptical in shape. Perforated plate 200 includes a plurality of openings 202 or perforations formed therethrough. Specifically, the plurality of openings 202 extend from a top surface 204 to a bottom surface (not shown) of base plate 203. As shown, the plurality of openings 202 may be circular, but in other embodiments, the plurality of openings 202 may be square, triangular, or any other shape. One of ordinary skill in the art will appreciate that the shape of the openings 202 may be selected based on the materials to be separated. Perforated plate 200 may be formed from various metals, alloys, or combination thereof known in the art. In certain embodiments, the perforated plate 200 is formed from stainless steel. In other embodiments, the perforated plate may be formed from composite plastic materials, including, for example, high-strength plastic, mixtures of high-strength plastic and glass, high-strength plastic reinforced with high-tensile-strength steel rods, and any combination thereof. For example, in some embodiments, the perforated plate may be formed from acrylonitrile butadiene styrene (ABS), polypropylene, modified phenylene oxide polyethylene, styrene-maleic-anhydride, or polycarbonates. In some embodiments, the perforated plate 200 may include various coating applied thereon to prevent corrosion or adhesion of materials to the base plate 203. An example coating may include polytetrafluoroethylene (PTFE).

As shown, the top surface 204 of base plate 203 is substantially planar. In other embodiments, the top surface 204 of base plate 203 may be arcuate, for example, convex or slightly concave. Similarly, the bottom surface (not shown) of base plate 203 may be substantially planar, convex, or concave. A flange 206 is integrally formed along an outer circumference of base plate 203 and configured to engage an outer frame of a sifter or separator (not shown). The flange 206 may include multiple portions extending at various angles from the base plate 203, as discussed in more detail below.

Figure 3:
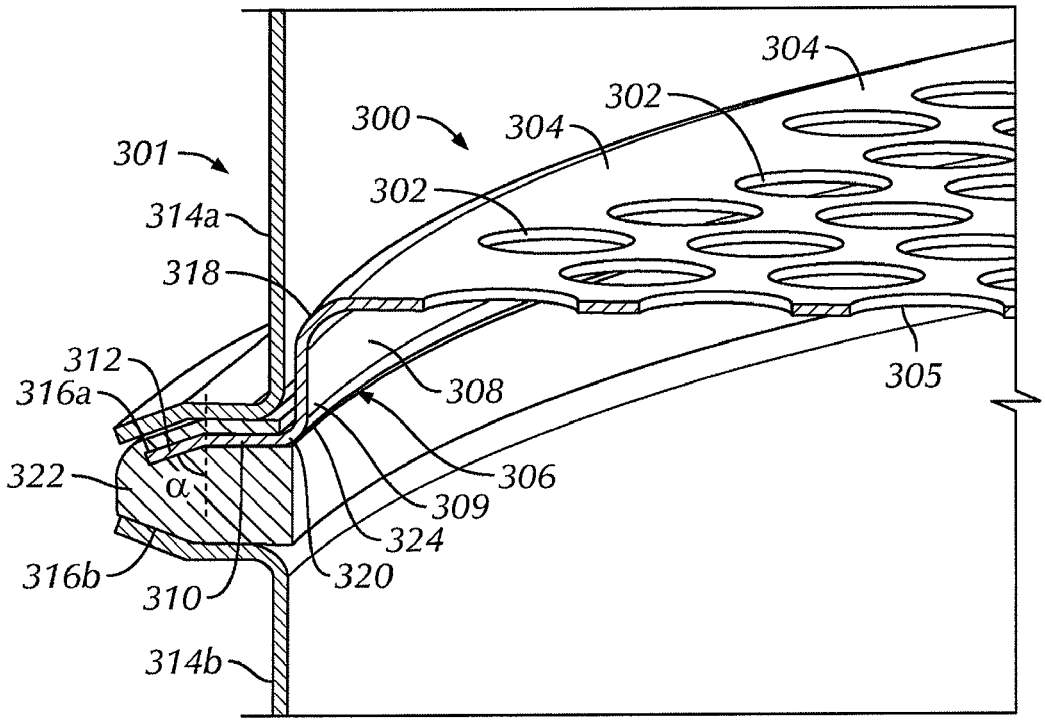
FIG. 3 is a partial cross-sectional view of a screen assembly for a vibratory sifter in accordance with embodiments disclosed herein.

Referring now to FIG. 3, a partial cross-sectional view of a screen assembly 301 in accordance with embodiments disclosed herein is shown. As shown, screen assembly 301 includes of a perforated plate 300 configured to be disposed in a vibratory sifter (not shown). Perforated plate 300 includes a base plate 303 having a top surface 304 and a bottom surface 305 with a plurality of openings 302 extending from the top surface 304 to the bottom surface 305, and a flange 306. The flange 306 is integrally formed with base plate 303 and extends around the circumference of the base plate 303, and is configured to engage with outer frames 314 of the sifter (not independently illustrated).

As shown, flange 306 includes three portions 308, 310, and 312. The first portion 308 of flange 306 extends downward perpendicularly from the top and bottom surfaces 304, 305 of the base plate 303. The second portion 310 of flange 306 extends radially outward from a lower circumference 309 of first portion 308. The third portion 312 of flange 306 extends radially outward and downward from an outer circumference of the second portion 310 at a predetermined angle $\alpha$. The predetermined angle $\alpha$ may be in a range between 5 degrees and 40 degrees from a plane parallel with second portion 310. The predetermined angle $\alpha$ may be selected based on, for example, the angle of engaging surfaces 316*a*, 316*b*, of outer frames 314*a*, 314*b* of the sifter (not independently illustrated).

As shown, a first transition area 318 between the perforated plate 300 and the integrally formed flange 306 and a second transition area 320 between the first portion 308 of the flange 306 and the second portion 310 of the flange may be rounded. The radius of the rounded transition areas 318, 320 may vary based on, for example, tolerances of the machines used to form the perforated plate 300 and, specifically, the integrally formed flange 306, discussed in more detail below, as well as the shape, angle, and/or size of the engagement surfaces 316*a*, 316*b* of the outer frames 314*a*, 314*b* of the sifter (not independently illustrated).

While embodiments disclosed herein illustrate a flange 306 having three portions, one of ordinary skill in the art will appreciate that a flange having one, two, or more portions formed at varying angles may be formed without departing from the scope of embodiments disclosed herein. For example, first portion 308 of flange 306 may extend downwardly from base plate 303 at a second predetermined angle (not shown), and second portion 310 of flange 306 may extend radially outwardly and downwardly at a third predetermined angle. Further, the flange or portions of the flange may extend upwardly with respect to the base plate 303.

Screen assembly 301 may also include a gasket 322 configured to couple to flange 306. In the embodiment shown, gasket 322 includes a circumferential groove 324 formed on an inner surface of the gasket 322 and configured to engage at least a portion of the flange 306, e.g., second and third portions 310, 312 of flange 306. As shown, the circumferential groove 324 may have a profile that corresponds to the profile of the flange 306 so as to provide a tight seal against the flange 306. The gasket 322 may be formed from any material known in the art for providing a seal. For example, the gasket 322 may be formed from an elastomer, such as ethylene propylene diene monomer or neoprene, or a plastic, for example, PTFE. For vibratory sifters used in applications that require high sanitation standards, gasket 322 may be formed from silicone.

As discussed above, the gasket 322 is coupled to the flange 306 by, for example, inserting at least a portion of the flange 306 into the circumferential groove 324 of the gasket 322. In some embodiments, an adhesive may be applied to the circumferential groove 324 to further secure the gasket 322 to the flange 306. The screen assembly 301, including the perforated plate 300 and gasket 322, may then be coupled with the vibratory sifter (not independently illustrated). Specifically, the gasket 322 may be snapped into position, e.g., interference fit, between engagement surfaces 316*a*, 316*b* of outer frames 314*a*, 314*b* of vibratory sifter (not independently illustrated). Alternatively, gasket 322 may be clamped into position between engagement surfaces 316*a*, 316*b* of outer frames 314*a*, 314*b* of vibratory sifter (not independently illustrated) using clamps, bolts, screws, or other devices known in the art for securing the gasket 322 within the engagement surfaces 316*a*, 316*b*.

Figure 4:
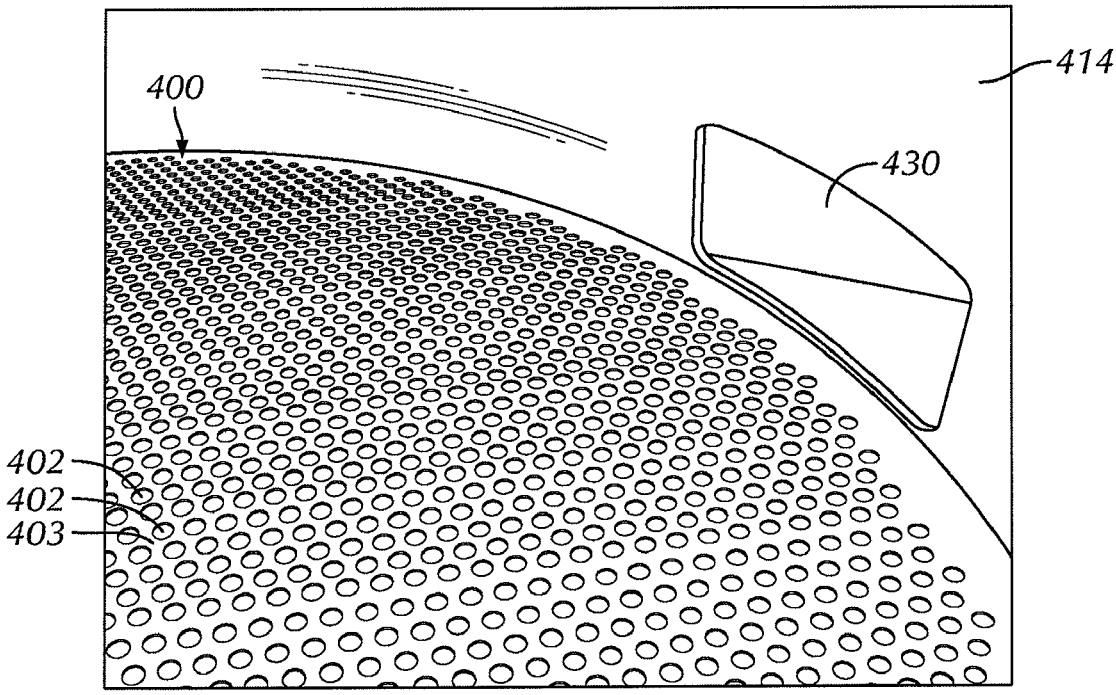
FIG. 4 is a perspective view of a screen assembly assembled in a vibratory sifter in accordance with embodiments disclosed herein.

Referring now to FIG. 4, a perforated plate 400 in accordance with embodiments disclosed herein is shown assembled in a vibratory sifter (not independently illustrated). As shown, the perforated plate 400 includes a base plate 403 and a flange (not shown) engaged with an outer frame 414 of the vibratory sifter (not independently illustrated). The frame 414 includes an opening 430 through which material larger than the plurality of openings 402 may pass to be discharged or further processed. As discussed above, a gasket (not shown) may be coupled to the flange (not shown) of the perforated plate 400 to sealingly engage the perforated plate 400 with the frame 414 of the vibratory sifter (not independently illustrated) so that material may not bypass the perforated plate 400.

Figure 5A:
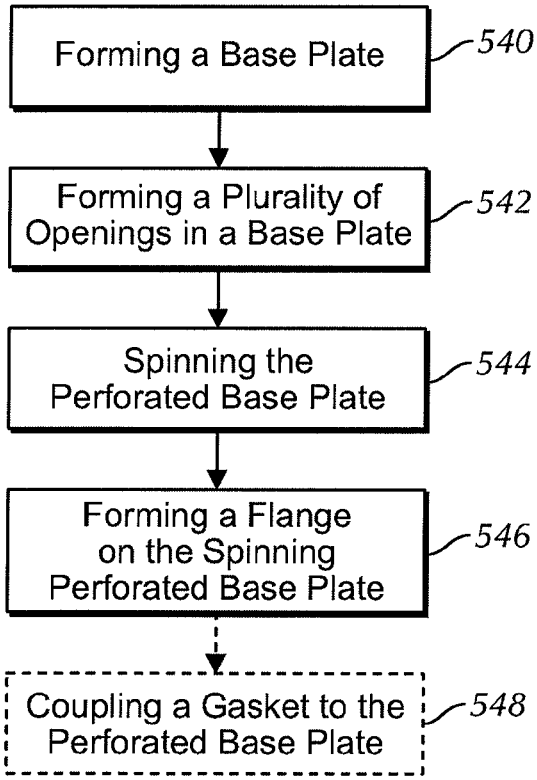
FIG. 5A is a flow diagram of a method of forming a screen assembly in accordance with embodiments disclosed herein.

FIG. 5A shows a method of forming a screen assembly for a vibratory sifter in accordance with embodiments disclosed herein. In one embodiment, a base plate may be initially formed 540 from, for example, steel, by any method known in the art, for example, by rolling pressing steel into a desired geometry or stamping a sheet of metal. The base plate may be formed in a circular or elliptical shape. In certain embodiments, the top and bottom surfaces of the formed base plate is planar, while in other embodiments, the top and bottom surface of the formed base plate may have a slightly convex or concave profile.

Once the base plate is formed, a plurality of openings extending from a top surface to a bottom surface of the base plate is formed 542 in the base plate. The plurality of openings may be formed in the base plate by any method known in the art. For example, the plurality of openings may be punched through the base plate using a high speed punch or a laser to burn through the base plate and cut the plurality of openings from the base plate. In some embodiments, the high speed punch or laser may be numerically controlled to cut openings in a desired shape and pattern on the base plate. One of ordinary skill in the art will appreciate that the shape and pattern of openings formed in the base plate may vary based on, for example, the size and shape of the material to be separated.

The perforated base plate may then be mounted in a spinning machine, for example, a lathe, wherein the base plate is rotated or spun 544 at a predetermined speed. One of ordinary skill in the art will appreciate that the predetermined speed of rotation of the base plate may be selected based on, for example, the material of the base plate, the thickness of the base plate, the diameter of the base plate, etc. To spin the base plate in the lathe, a mandrel, or form, is inserted in the drive section of the lathe. The base plate is coupled to the mandrel, for example, by a clamp or pressure pad attached to a tailstock of the lathe. As the base plate and mandrel are rotated at a high speed, a tool may apply a force to the base plate proximate the outer circumference of the base plate to cause the base plate material to flow in a direction of the applied force to form an integral flange 546. In certain embodiments, a mold, for example, a wood mold, may be formed having a profile that corresponds to a desired profile of the flange to be formed on the base plate. Examples of desired flange profiles in accordance with embodiments disclosed herein are disclosed above. In this embodiment, the mold may be held proximate the outer circumference of the base plate, and, as the base plate and mandrel rotate, a tool contacts a portion of the spinning base plate proximate the outer circumference of the base plate and moves the metal of the spinning base plate into the mold. Once the metal proximate the outer circumference of the spinning base plate is moved or forced into the complete profile of the mold, the tool and mold may be removed, the spinning machine stopped, and the base plate removed from the machine. The complete perforated plate includes the base plate, having a plurality of openings formed therethrough, and an integrally formed flange.

Figure 5B:
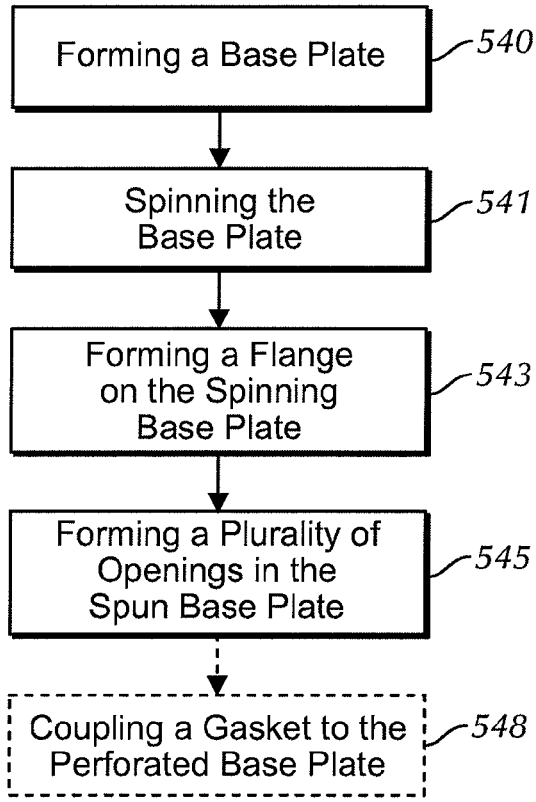
FIG. 5B is a flow diagram of a method of forming a screen assembly in accordance with embodiments disclosed herein.

In certain embodiments, the base plate may be spun prior to forming a plurality of openings in the base plate, as shown in FIG. 5B and detailed below. The plurality of openings in the base plate may be formed after the base plate is spun when larger openings in the base plate are desired. Once the base plate is formed 540, the base plate may be mounted in a spinning machine, for example, a lathe, wherein the base plate is rotated or spun 541 at a predetermined speed. One of ordinary skill in the art will appreciate that the predetermined speed of rotation of the base plate may be selected based on, for example, the material of the base plate, the thickness of the base plate, the diameter of the base plate, etc. To spin the base plate in the lathe, a mandrel, or form, is inserted in the drive section of the lathe. The base plate is coupled to the mandrel, for example, by a clamp or pressure pad attached to a tailstock of the lathe. As the base plate and mandrel are rotated at a high speed, a tool may apply a force to the base plate proximate the outer circumference of the base plate to cause the base plate material to flow in a direction of the applied force to form an integral flange 543. In certain embodiments, a mold, for example, a wood mold, may be formed having a profile that corresponds to a desired profile of the flange to be formed on the base plate. Examples of desired flange profiles in accordance with embodiments disclosed herein are disclosed above. In this embodiment, the mold may be held proximate the outer circumference of the base plate, and, as the base plate and mandrel rotate, a tool contacts a portion of the spinning base plate proximate the outer circumference of the base plate and moves the metal of the spinning base plate into the mold. Once the metal proximate the outer circumference of the spinning base plate is moved or forced into the complete profile of the mold, the tool and mold may be removed, the spinning machine stopped, and the base plate removed from the machine.

Once the base plate is formed and removed from the spinning machine, a plurality of openings extending from a top surface to a bottom surface of the spun base plate is formed 545 in the base plate. The plurality of openings may be formed in the base plate by any method known in the art. For example, the plurality of openings may be punched through the base plate using a high speed punch or a laser to burn through the base plate and cut the plurality of openings from the base plate. In some embodiments, the high speed punch or laser may be numerically controlled to cut openings in a desired shape and pattern on the base plate. One of ordinary skill in the art will appreciate that the shape and pattern of openings formed in the base plate may vary based on, for example, the size and shape of the material to be separated. The complete perforated plate includes the base plate, having a plurality of openings formed therethrough, and an integrally formed flange.

After the perforated plate is removed from the spinning machine, a gasket may be coupled 548 to the flange. In one embodiment, a circular gasket having an inner diameter substantially the same or less than the outer diameter of the formed flange may include a circumferential groove formed on the inner surface of the gasket. The circumferential groove may extend radially into the gasket and have a profile that corresponds to the profile of the flange. The gasket may then be stretched or forced over the perforated plate such that the flange is inserted in the circumferential groove. Thus, the gasket may be securely coupled to the perforated plate without adhesives, tension rings, or other attachment devices. In some embodiments, an adhesive may be applied to the flange or gasket to further secure the flange within the gasket.

In an alternate embodiment, after the openings have been formed in the base plate, the base plate may be mounted in a stamping press to form an integral flange. A stamping press is a metalworking tool used to shape metal by deforming it with a die. In this embodiment, the perforated base plate may be inserted into the die of the stamping press. A ram of the stamping press is then stroked (i.e., moved downward) against the base plate to bend or form the base plate to create a flange. The die may be configured to provide a flange having one, two, or more portions at various angles, as described above.

In yet other embodiments wherein the base plate is formed from a plastic or composite plastic material, the integral flange may be formed on the base plate using vacuum forming. In this embodiment, the formed base plate is heated to a forming temperature. The heated base plate may then be stretched onto or into a mold and held against the mold by applying a vacuum between the mold surface and the sheet. The mold may be configured to provide a flange having one, two, or more portions at various angles, as described above.

In certain embodiments, a coating may be applied to the base plate of the perforated plate to prevent corrosion of the base plate and/or to prevent adhesion of material to the base plate. The coating may be applied to the base plate by any method known in the art, for example, spraying or painting.

A screen assembly formed in accordance with embodiments disclosed herein may be assembled in a vibratory sifter by simply inserting the gasket coupled to the perforated plate into a screen retainer or a screen groove formed in the outer frame of the vibratory sifter. In one embodiment, the outer frame of the vibratory sifter includes an upper engagement surface and a lower engagement surface configured to receive and engage the gasket and flange of the screen assembly. In one embodiment, the gasket may be press fit into the screen retainer or screen groove of the frames, while in other embodiments, the gasket may be clamped or otherwise secured in the screen retainer or screen groove of the frames.

Figure 6A:
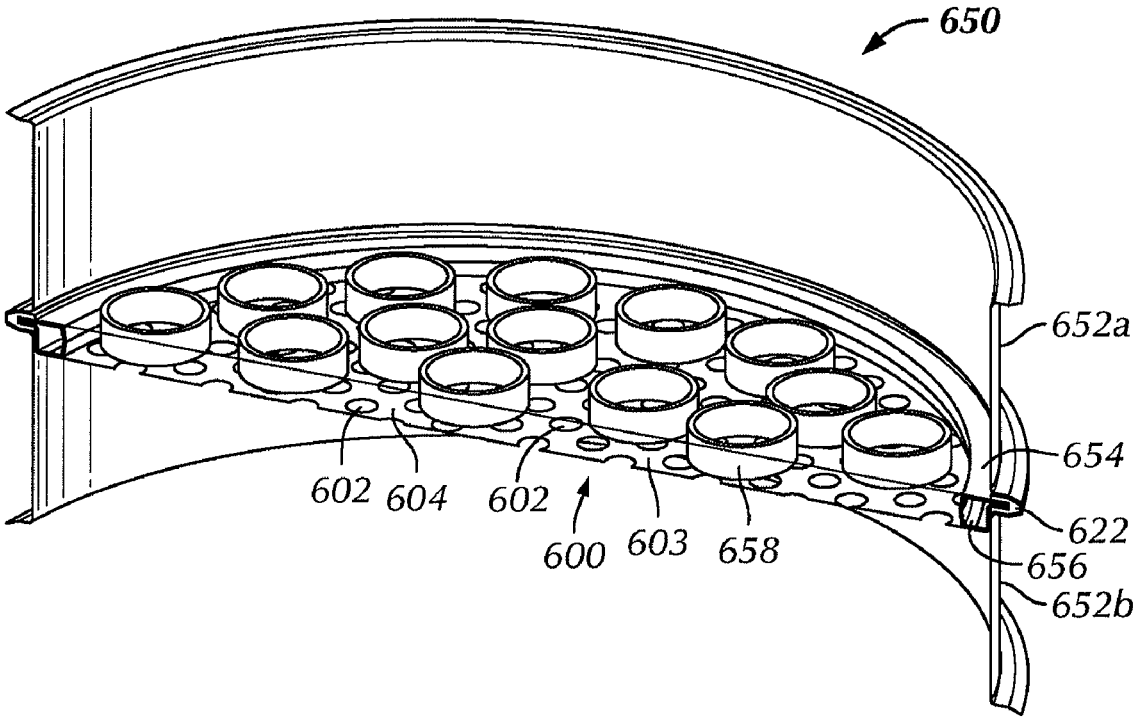
FIGS. 6A and 6B show an assembly view and an exploded view of a self-cleaning screen assembly in accordance with embodiments disclosed herein.
Figure 6B:
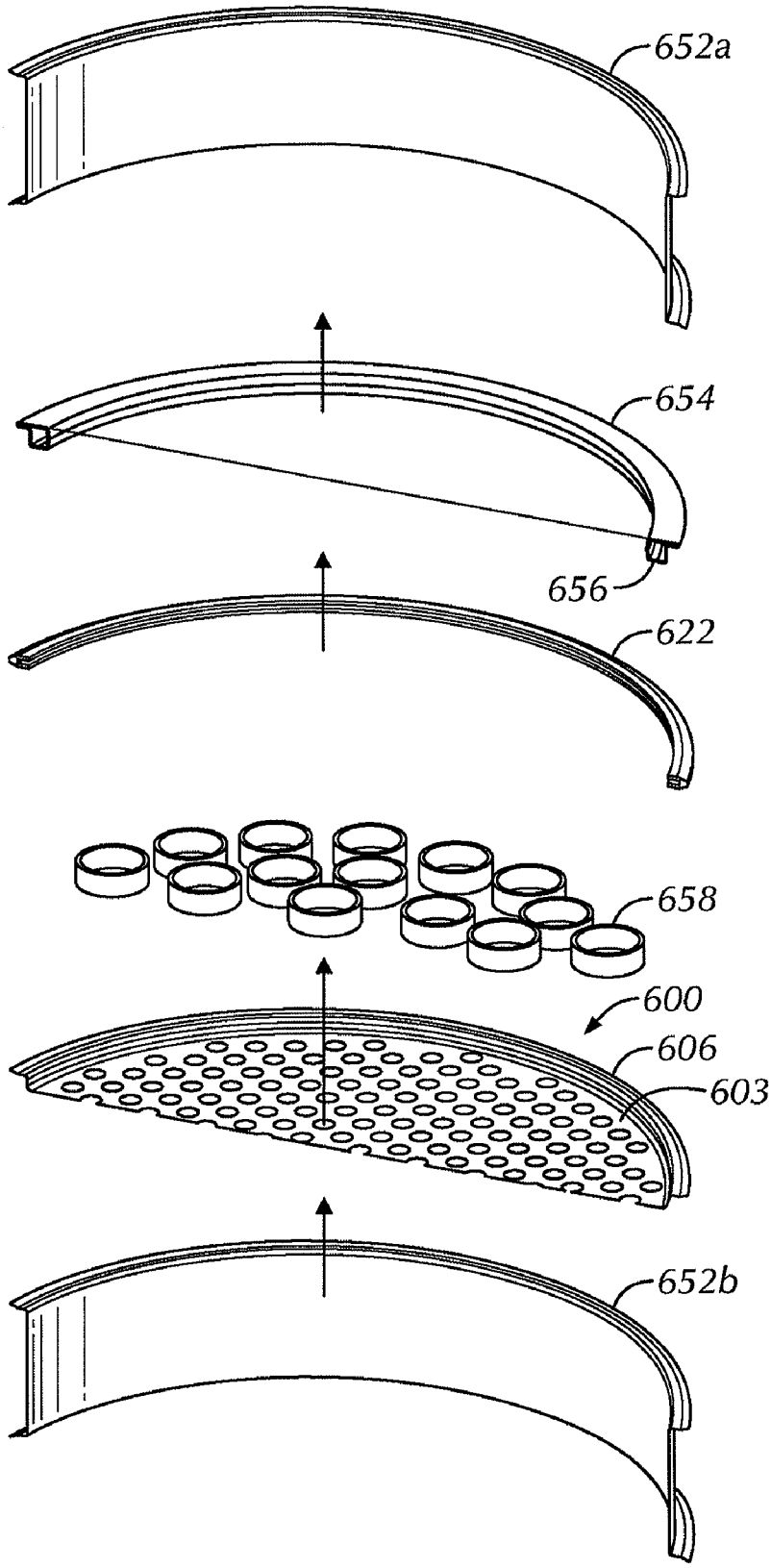

In certain embodiments, a perforated plated in accordance with embodiments described above with reference to FIGS. 2-4 may be used in a screen assembly that provides self-cleaning of a mesh layer and/or the plurality of openings of the base plate. FIGS. 6A and 6B show an assembly view and an exploded view of a self-cleaning screen assembly in accordance with embodiments disclosed herein. As shown, the self-cleaning screen assembly 650 includes an outer screen frame 652 and a perforated plate 600 having a base plate 603, formed in accordance with embodiments described above. Perforated plate 600 includes a plurality of openings 602 or perforations formed therethrough. Outer screen frame 652 may include a first portion 652*a* and a second portion 652*b* configured to coupled together and secure the perforated plate 600 therebetween.

A top surface 604 of base plate 603 is substantially planar. In other embodiments, the top surface 604 of base plate 603 may be arcuate, for example, convex or slightly concave. Similarly, a bottom surface (not shown) of base plate 603 may be substantially planar, convex, or concave. A flange 606 is integrally formed along an outer circumference of base plate 603 and configured to engage the outer screen frame 652 of a sifter or separator (not shown). The flange 606 may include multiple portions extending at various angles from the base plate 603, as discussed in detail above. Self-cleaning screen assembly 650 may also include a gasket 622 configured to couple to flange 606.

The self-cleaning screen assembly 650 further includes a filter element 654 disposed a selected distance above (i.e., on an upstream side of) the perforated plate 600. The filter element 654 may include a woven mesh stretched across a filter element frame 656. The filter element frame 656 may be configured to engage the flange 606 of the perforated plate 600 and/or the outer screen frame 652. The perforated plate 600 includes openings 602 that are larger than openings (not shown) in the filter element 654, thereby assuring that substantially all material that passes through the filter element 654 may also pass through the perforated plate 600.

The self-cleaning screen assembly 650 further includes at least one deblinding device 658 disposed in a space between the filter element 654 and the perforated plate 600. As shown, the at least one deblinding device 658 may include one or more cylindrical sliders having a height approximately equal to or less than the selected distance between the filter element 654 and the perforated plate 600. In other embodiments, the deblinding device 658 may include balls having a diameter approximately equal to or less than the distance between the filter element 654 and the perforated plate 600, or any other deblinding device known in the art. The at lest one deblinding device 658 is configured to be trapped between the filter element 654 and the perforated plate 600 and configured to move laterally (i.e., slide or roll) and/or axially due to vibration of the sifter or separator (not shown). During vibration of the filter screen, the deblinding device vibrates or hammers against the filter element 654 to reduce clogging, plugging, or blinding of the filtering element 654. This arrangement may be referred to as a deblinding kit, as the hammering of the deblinding device provides a mechanism to reduce the blinding of the openings (not shown) of the filtering element 654 and the openings 602 of the perforated plate 600.

Advantageously, embodiments disclosed herein provide a screen assembly having a perforated plated with an integrally formed flange and a gasket for quick and simple assembly and disassembly of the screen assembly in a vibratory sifter. A screen assembly formed in accordance with embodiments disclosed herein may eliminate the need for adhesives that may be incompatible or unsanitary for certain applications. Additionally, additional components, such as tension rings, are not necessary for assembling the screen assembly in the vibratory separator. Further, by eliminating the need for such additional components, welding of these components to the perforated plate is not required.

When typical tension rings are welded to the perforated plate, the heating and cooling of the material often causes distortion of the thin perforated plate, which may also distort the desired shape and size of the openings in the perforated plate and/or distort the flat, smooth surface of the perforated plated. Screen assemblies in accordance with embodiments of the present disclosure advantageously eliminate the need for welding components to the perforated plate, and therefore maintain the desired shape and size of the openings for separating material, as well as the desired flat, smooth surface of the perforated plate. Furthermore, punching or stamping holes in the base plate may stretch or distort the flat surface of the perforated plate. During spinning of the perforated plate in accordance with embodiments disclosed herein, any distortion of the metal plate formed during the punching or stamping process may be advantageously flattened or smoothed.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed:

1. A perforated plate for a vibratory sifter, the perforated plate comprising:

a base plate comprising a plurality of openings formed therethrough; and a flange integrally formed with the base plate, wherein the flange comprises:

a first portion extending perpendicularly downward from a planar surface of the base plate;

a second portion extending radially outward from a lower circumference of the first portion; and a third portion extending radially outward from an outer circumference of the second portion at a predetermined angle.

2. The perforated plate of claim 1, wherein the base plate is planar.

3. The perforated plate of claim 1, wherein the base plate is circular.

4. The perforated plate of claim 1, wherein the third portion is parallel to an engagement surface of a frame of the vibratory sifter.

5. The perforated plate of claim 1, wherein the second portion is parallel to the planar surface of the base plate.

6. A screen assembly for a vibratory sifter, the screen assembly comprising:

a base plate comprising a plurality of openings formed therethrough;

a flange integrally formed with the base plate, wherein the flange comprises:

a first portion extending perpendicularly downward from a planar surface of the base plate;

a second portion extending from a lower circumference of the first portion and parallel to the planar surface of the base plate; and a third portion extending from an outer circumference of the second portion at a predetermined angle; and a gasket coupled to at least a portion of the flange.

7. The screen assembly of claim 6, wherein the gasket comprises a circumferential groove formed on an inner surface of the gasket and wherein the third portion is disposed in the circumferential groove.

8. The screen assembly of claim 6, wherein the gasket is formed from at least one of an elastomer material and a plastic material.

* * * * *